US006866239B2

(12) United States Patent
Miller et al.

(10) Patent No.: US 6,866,239 B2
(45) Date of Patent: Mar. 15, 2005

(54) CONCRETE FORM ASSEMBLY

(75) Inventors: Thomas E. Miller, Mequon, WI (US); Erik C. Peterson, Milwaukee, WI (US)

(73) Assignee: Metal Forms Corporation, Milwaukee, WI (US)

( * ) Notice: Subject to any disclaimer, the term of this patent is extended or adjusted under 35 U.S.C. 154(b) by 0 days.

(21) Appl. No.: 10/337,798

(22) Filed: Jan. 7, 2003

(65) Prior Publication Data

US 2003/0146365 A1 Aug. 7, 2003

Related U.S. Application Data

(63) Continuation-in-part of application No. 09/507,552, filed on Feb. 18, 2000, now Pat. No. 6,629,681.

(51) Int. Cl.[7] ..... E01C 7/00; E06B 1/20; E04G 11/00

(52) U.S. Cl. ..... 249/3; 249/2; 249/6; 249/7; 249/13; 249/207; 249/192; 249/196; 52/85; 52/245; 404/98

(58) Field of Search ..... 249/2–9, 40, 13, 249/207, 189, DIG. 3; 52/85, 245; 404/96, 98

(56) References Cited

U.S. PATENT DOCUMENTS 1,379,457 A * 5/1921 Loxterman ..... 249/6
1,512,165 A * 10/1924 Funkhouser ..... 249/6
1,739,254 A * 12/1929 Mosel ..... 249/2
1,827,672 A * 10/1931 Rogers ..... 249/7
2,793,416 A * 5/1957 Yearling ..... 249/6
4,579,312 A * 4/1986 White ..... 249/6
4,712,764 A * 12/1987 White ..... 249/6
4,824,068 A * 4/1989 Ferland ..... 249/2
5,154,837 A * 10/1992 Jones ..... 249/2
5,261,635 A * 11/1993 Flathau ..... 249/7
5,830,378 A * 11/1998 Butler ..... 249/18
5,869,453 A * 2/1999 Moss et al. ..... 514/16
6,021,994 A * 2/2000 Shartzer, Jr. ..... 249/6
6,629,681 B1 * 10/2003 Miller et al. ..... 249/3

* cited by examiner

*Primary Examiner*—Jong-Suk (James) Lee
(74) *Attorney, Agent, or Firm*—Sonnenschein Nath & Rosenthal LLP

(57) ABSTRACT

A form assembly for forming a concrete structure during drying of the concrete. The form assembly is formed of an elongated plastic form having a front wall for engaging the concrete and a rear wall. The front wall is spaced apart from the back wall to define a pocket for receiving at least one connecting member. The connecting member is secured in the pocket to project a distance beyond an end of the form. A slidable stake holder may also be provided to slide in a C-shaped pocket in the form. The stake holder has right and left flanges that abuttingly engage the rear wall and at least one preformed nail hole is provided in each of the right and left flanges.

18 Claims, 7 Drawing Sheets

CONCRETE FORM ASSEMBLY

This application is a continuation-in-part application of U.S. Ser. No. 09/507,552, filed Feb. 18, 2000, now U.S. Pat No. 6,629,681.

FIELD OF THE INVENTION

The present invention relates generally to forms used for pouring concrete structures and, more specifically, to a flexible form assembly that may be used for pouring concrete structures of varying shapes. Further, the present invention relates to means for connecting flexible forms used for pouring concrete structures.

BACKGROUND OF THE INVENTION

Flexible forms are often used for the purpose of pouring concrete structures such as curbs, walls, sidewalks or other structures of varying shapes. Typically, flexible and rigid sheet metal forms or wooden forms are used and, more recently, plastic forms have been employed.

However, wooden forms are not preferred because they are generally not reuseable and are difficult to use due to their lack of flexibility. Sheet metal forms, on the other hand, are flexible but are expensive and difficult to handle when pouring concrete structures of varying shapes. When pouring concrete structures with extreme changes in contour or shape, it has been found that wooden or sheet metal forms are impractical.

To remedy the deficiencies of sheet metal and wooden forms, plastic forms have been employed. One such system is sold under the PLASTIFORM™ trademark by the Plastiform Company of 14114 SE 162 Pl., Renton, Wash. 98058. However, these currently-available plastic form assemblies are problematic for a number of reasons. First, the PLASTIFORM™ assemblies are provided with nylon clamps that clamp the plastic form to a stake that has already been driven into the ground. Because the stake must be driven into the ground prior to being clamped to the form, there is no means for easily adjusting the position of the stake with respect to the form. Second, in order to connect two adjoining forms together, two end caps are required. If the end caps become lost or misplaced, there is no other way to connect two adjoining plastic forms.

Accordingly, there is a need for an improved flexible form assembly that provides the benefits of lightweight plastic forms but which enables the form to be reinforceable or made more rigid for straight line work. Further, there is a need for an improved flexible form assembly which provides for improved stake pockets which provides both fixed stake pockets or slid able stake pockets. Still further, there is a need for an improved flexible form assembly which provides for a variety of means for connecting two adjoining plastic forms together, such as hinge arrangements or the use of stake pockets to connect two forms together in addition to the use of end caps.

SUMMARY OF THE INVENTION

The aforenoted needs are satisfied by the present invention which provides an improved flexible form assembly. The flexible form assembly of the present invention includes an improved form design which enables the plastic forms to be easily and conveniently reinforceable and attached to one another. The present invention also provides an improved slidable stake pocket design which enables the stake pocket to also be attached to wooden forms.

In an embodiment, a form assembly for forming a concrete structure during drying of the concrete is provided, the form assembly including an elongated plastic form having a front wall for engaging the concrete and a rear wall, the front wall being spaced apart from the back wall, the front and back walls defining a pocket for receiving at least one connecting member, and the connecting member being secured in the pocket to project a distance beyond an end of the form.

In an embodiment, the at least one connecting member is secured to one of the walls of the form by at least one mechanical fastener.

In an embodiment, the at least one connecting member has a tapered end.

In an embodiment, the at least one connecting member includes two connecting members, one spaced above the other.

In an embodiment, the at least one connecting member includes a flexible plastic member.

In an embodiment, the flexible plastic connecting member extends into the form approximately the same distance as it projects beyond the end.

In an embodiment, the at least one connecting member comprises a rigid aluminum tube.

In an embodiment, the rigid aluminum tube extends substantially an entire length of the form to reinforce the length of the form.

In an embodiment, the at least one connecting member projects beyond the end of the form a distance in the range of 3–6 inches.

In an embodiment, the at least one connecting member projects beyond the end of the form a distance of approximately 4.5 inches.

In an embodiment, a form assembly is provided for forming a concrete structure during drying of the concrete, the form assembly including an elongated form having a front side for engaging the concrete and a rear side, the rear side including a back wall disposed between rearwardly extending top and bottom walls, the top wall being connected to a downwardly protruding upper lip, the bottom wall being connected to an upwardly protruding lower lip, the upper and lower lips, the top and bottom walls and the back wall forming a C-shaped pocket for receiving a slidable stake holder, the stake holder including right and left flanges that abuttingly engage the back wall, that fit between said top and bottom walls and that are partially disposed between the upper and lower lips and the back wall such that the stake holder can slide along the back wall, the stake holder further including a pocket portion that is connected to and disposed between the right and left flanges, the pocket portion extending outward rearwardly to define an apex which provides a looped pocket for receiving a stake; and the stake holder further including at least one preformed nail hole in each of the right and left flanges.

In an embodiment, the elongated form includes a front wall at said front side for engaging the concrete, the front wall being spaced apart from the back wall, the front and back walls defining a pocket for receiving at least one connecting member, the connecting member being secured in the pocket to project a distance beyond an end of the form.

In an embodiment, the elongated form is formed of a flexible plastic material.

In an embodiment, a form assembly is provided for forming a concrete structure during drying of the concrete, the form assembly including an elongated plastic form having a front wall for engaging the concrete and a rear wall, the front wall being spaced apart from the back wall, the front and back walls defining a pocket for receiving at least two connecting members spaced one above the other, the connecting members being secured in the pocket to project a distance beyond an end of the form, the connecting members being secured to one of the walls of the form by at least one mechanical fastener, the connecting members each having a commonly tapered projecting end, and the connecting members projecting beyond the end of the form a distance in the range of 3–6 inches.

These and other objects and advantages of the present invention will become apparent upon reading the following detailed description and upon reference to the accompanying drawings.

BRIEF DESCRIPTION OF THE DRAWING

For a more complete understanding of the present invention, reference should now be made to the embodiments illustrated in greater detail in the accompanying drawings and described below by way of examples of the invention.

In the drawings.

It should be understood that the drawings are not necessarily to scale and that the embodiments are sometimes illustrated by graphic symbols, phantom lines, diagrammatic representations and fragmentary views. In certain instances, details which are not necessary for an understanding of the present invention or which render other details difficult to perceive may have been omitted. It should be understood, of course, that the invention is not necessarily limited to the particular embodiments illustrated herein.

DETAILED DESCRIPTION OF THE PREFERRED EMBODIMENT

Figure 1:
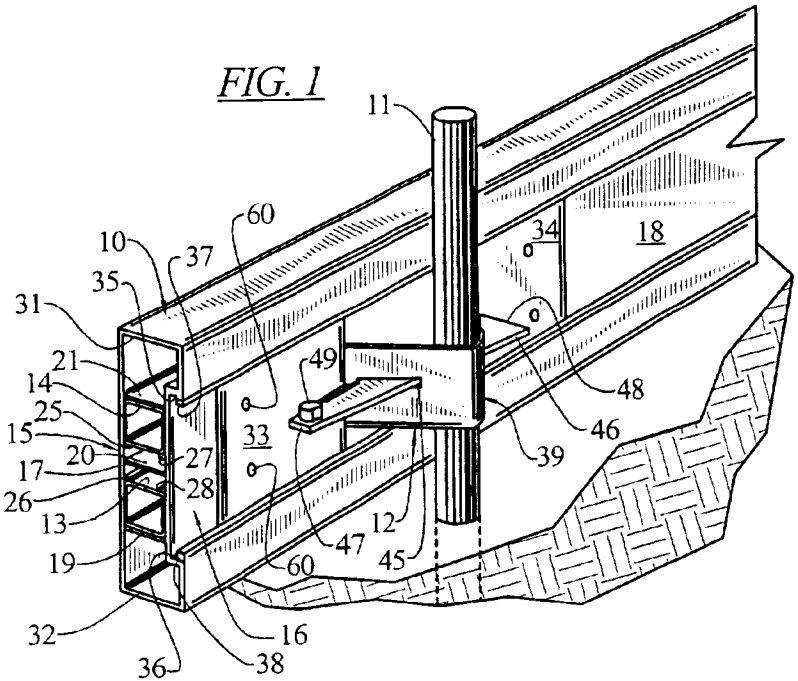
FIG. 1 is a perspective view of a flexible form, slidable pocket, stake and reinforcing tubular rods made in accordance with the present invention.

Turning first to FIG. 1, a form 10 is illustrated as connected to a stake 11 by a slidable stake pocket 12. The form 10 has also been reinforced with two tubular reinforcing rods 13, 14.

Figures 5, 6, 7, 8, 9:
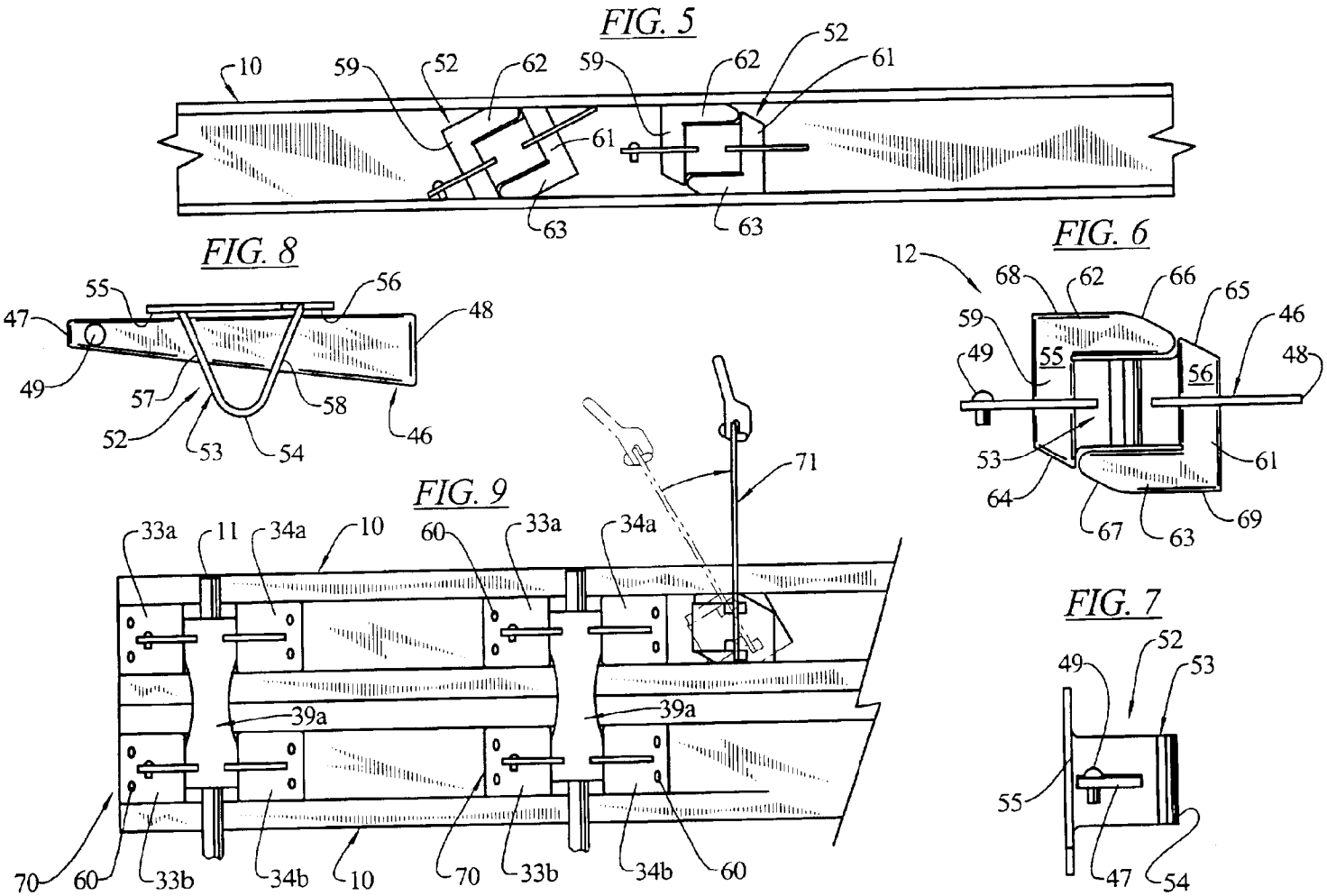
FIG. 5 is a plan view illustrating the installment of a fixed pocket in a flexible form made in accordance with the present invention.
FIG. 6 is a front view of the fixed pocket shown in FIG. 5.
FIG. 7 is a side view of the fixed pocket shown in FIG. 5.
FIG. 8 is a plan view of the fixed pocket shown in FIG. 5.
FIG. 9 illustrates another embodiment of the present invention which includes two forms stacked one on top of the other and connected by sliding stake pockets, as well as the installment of a hanger for connecting the two forms shown in FIG. 9 with a third form (not shown)
Figure 10:
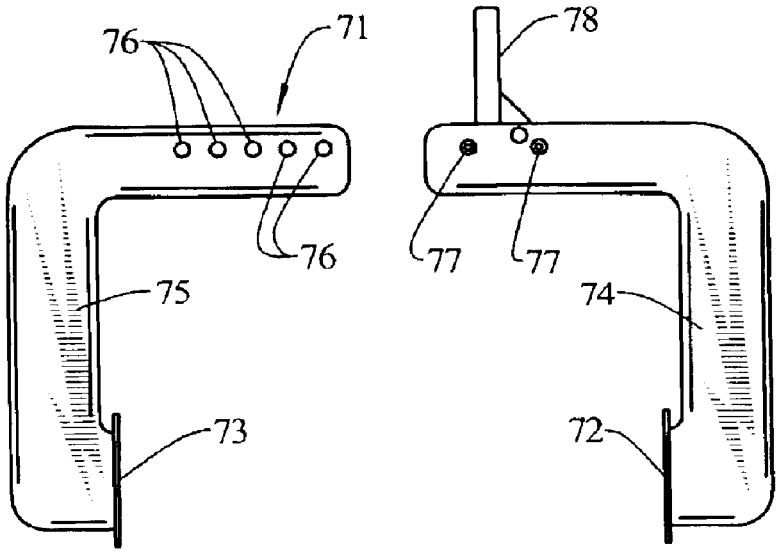
FIG. 10 is an exploded view of the hanger shown in FIG. 9.
Figure 11:
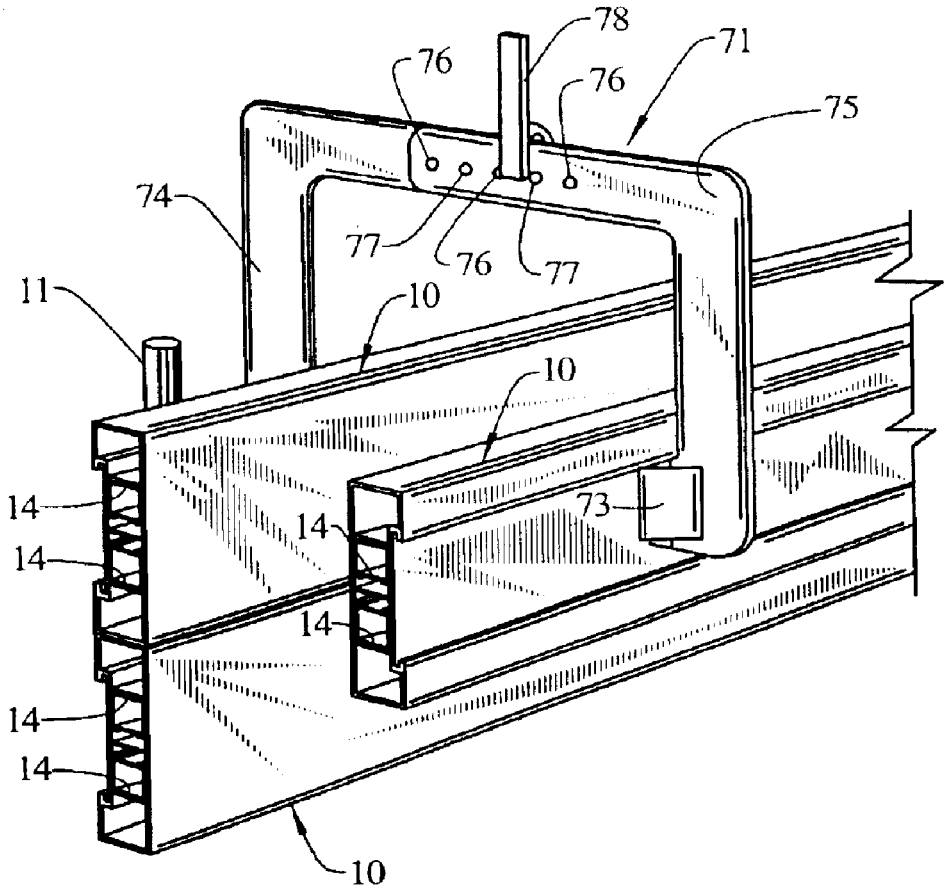
FIG. 11 is a perspective view of the hanger shown in FIGS. 9 and 10 as installed on three forms, two of which are connected together in the manner illustrated in FIG. 9.

The flexible form 10 includes a front side 15 which engages the concrete and a rear side 16 which is used for connecting the form 10 to a stake, such as 11 or to another form as shown in FIGS. 9 and 11 or to a hanger, also shown in FIGS. 9 and 11. The front side 15 includes a front wall 17 which is spaced apart from the wall 18 by one or more horizontal walls 19, 20, 21. The spacing between the front wall 17 and the rear wall 18 provides for a sufficient pocket or spacing so as to enable the form 10 to be reinforced with the hollow tubular rods shown at 13, 14. In a preferred embodiment, the tubes or rods 13, 14 are fabricated from aluminum because they are stiff, light and resistant to warping. Also in a preferred embodiment, the flexible form 10 is fabricated from high density polyethylene because of its stiffness and resistance to swelling when exposed to water.

In the embodiment illustrated in FIG. 1, the front wall 17 is connected to top and bottom ledges 25, 26 and the rear wall 18 is similarly connected to top and bottom ledges 27, 28. The top ledges 25, 27 and the top horizontal wall 21 form a pocket for receiving the aluminum tube 14.

It will be noted that the flexible form 10 has a C-shaped cross section for receiving the left and right flanges 33, 34 of the slidable stake pocket 12. Specifically, the C-shaped cross section is defined by the rear wall 18, the top and bottom walls 35, 36, the downwardly protruding lip 37 and the upwardly protruding lip 38. The C-shaped pocket formed by the rear wall 18, the bottom and top walls 35, 36 and the downwardly and upwardly protruding lips 37, 38 slidably receives the flanges 33, 34 of the slidable stake pocket assembly 12.

Figure 2:
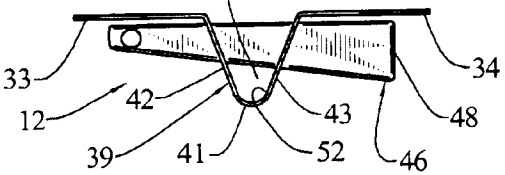
FIG. 2 is a plan view of the slidable stake pocket shown in FIG. 1.
Figure 3:
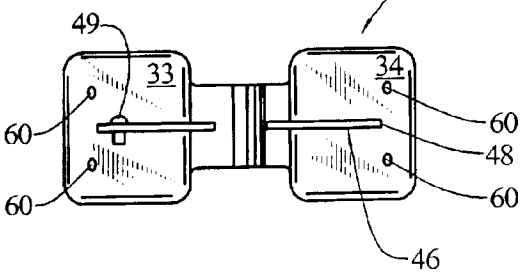
FIG. 3 is a front view of the slidable stake pocket shown in FIG. 1.
Figure 4:
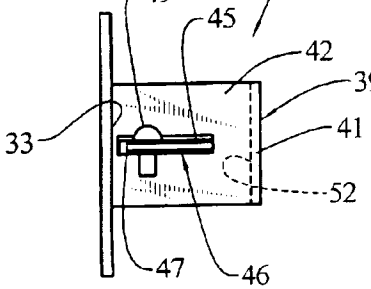
FIG. 4 is a side view of the slidable stake pocket shown in FIG. 1.

Turning to FIGS. 2–4, the slidable stake pocket assembly 12 includes a V-shaped pocket portion 39 which includes an apex 41 that is connected to the left and right flanges 33, 34 respectively by the angled side walls 42, 43. The angled side walls 42, 43 each comprise a slot such as the slot 45 shown in FIGS. 1 and 4 for receiving the angled wedge 46. The wedge 46 includes a narrow front end 47 and a wider rear end 48. The narrow front end 47 includes a retainer 49 which precludes removal of the wedge 46 from the pocket portion 39. After the stake 11 is inserted through the opening 51 defined by the pocket portion 39, force is applied to the rear end 48 of the wedge 46 to secure the position of the stake 11 against the inside surface 52 of the apex 41.

The slidable stake pocket assembly 12 may include one or more nail holes 60 formed in the left 33 and right 34 flanges. While the slidable stake pocket assembly 12 can slide along the length of the form 10 within the C-shaped pocket, so as to be positioned at any location along the length of the form, the stake pocket assembly 12 can also extend beyond an edge of the form to bridge the gap between two longitudinally adjacent forms so as to help strengthen and stabilize the joint between two adjacent forms. Further, if the plastic flexible form 10 is longitudinally abutted up to a wooden form, the nail holes 60 in one of the flanges can be used to secure the projecting flange to the wooden form, while the opposite flange is retained in the C-shaped pocket, thereby providing a connecting means between a wooden form and the flexible form 10. While the drawing illustrates two nail holes 60 provided on each flange, one above the other, a wide variety of nail holes and orientations could be used.

In addition to the slidable pocket assembly 12 illustrated in FIGS. 1–4, the present invention also provides for a fixed pocket assembly 52 illustrated in FIGS. 5–8. Specifically, the fixed pocket assembly 52 also includes a V-shaped pocket portion 53 that includes an apex 54 connected to left and right flanges 55, 56 by angled side walls 57, 58. Each flange 55, 56 includes a vertical leg portion 59, 61 respectively which is connected to the pocket portion 53. The vertical leg portions 59, 61 are, in turn, connected to horizontal leg portions 62, 63 respectively. The horizontal leg portions 62, 63 do not directly engage the pocket portion 53 as illustrated in FIG. 6 but, instead, are connected indirectly to the pocket portion 53 by the vertical leg portions 59, 61 respectively. The vertical leg portions 59, 61 each include a tapered distal end 64, 65 respectively. The tapered distal ends 64, 65 are in alignment with the tapered distal ends 66, 67 of the horizontal legs 62, 63 respectively. As a result, each pair of tapered ends 64, 67 and 65, 66 form an angled corner section which enables the pocket assembly 52 to be received in the form 10 as shown at the left in FIG. 5. The angled corner 64, 67 and 65, 66 enable a twisting of the assembly 52 to result in the assembly 52 assuming the position is shown at the right in FIG. 5. Thus, the pocket assembly 52 can be twisted into position. The assembly 52 is sized so that the upper and lower edges 68, 69 frictionally engage the upper and lower walls 35,36 (not shown in FIG. 5; see FIG. 1) of the form 10 to secure the pocket assembly 52 in a fixed and not slidable position. The pocket assembly 52 uses the wedge 46 illustrated in FIGS. 1–4 in the manner described above.

Turning to FIG. 9, it will be noted that two forms 10 may be stacked on top of each other to provide a wider surface for engaging the unhardened concrete. If this technique is employed, a modified version of the slidable pocket assembly 12 can be utilized as illustrated by the pocket assembly 70 illustrated in FIG. 9. Specifically, a modified pocket portion 39*a* is connected to an upper set of flanges 33*a*, 34*a* as well as a lower set of flanges 33*b*, 34*b* which, in turn, are received in the C-shaped pockets provided by the forms 10 as illustrated in FIG. 1.

Figure 12:
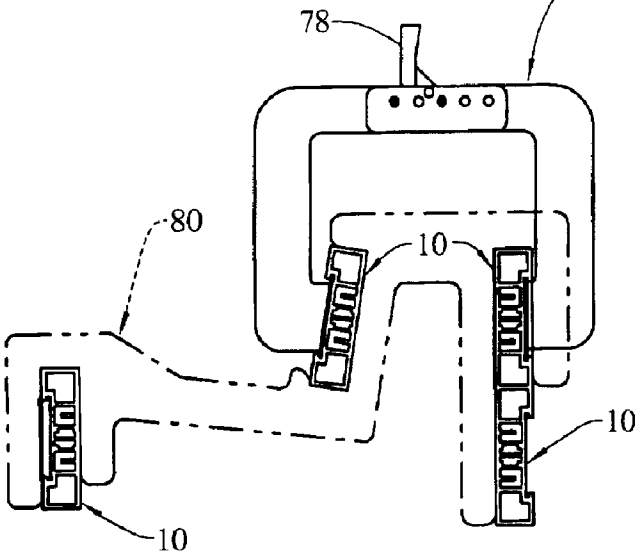
FIG. 12 is a front view illustrating the installment of the hanger and forms shown in FIG. 11 on a division plate.
Figure 14:
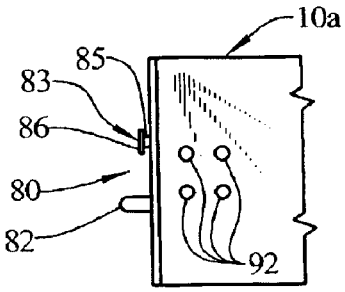
FIG. 14 illustrates an end of a form made in accordance with the present invention with an end cap installed thereon.
Figure 15:
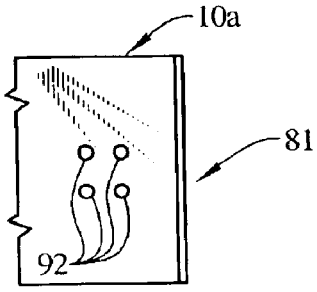
FIG. 15 illustrates an end of a form made in accordance with the present invention with an end cap installed thereon.
Figure 16:
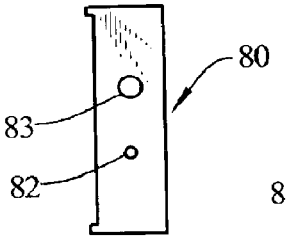
FIG. 16 is a front view of the end cap shown in FIG. 14.
Figure 17:
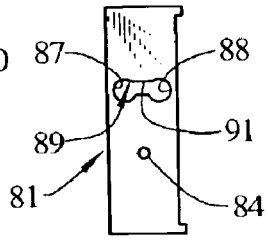
FIG. 17 is a front view of the end cap shown in FIG. 15.

FIG. 9 also illustrates the use of a hanger 71 which connects the double form structure shown in FIG. 9 to a third form 10 shown in FIG. 11 which is spaced apart from the two stacked forms 10. The hanger 71 is connected to the forms 10 by way of the flanges shown at 72, 73. The flanges are similarly received into the C-shaped pocket provided by the forms 10 by twisting the hanger 71 into place as illustrated in FIG. 9. The two halves 74, 75 of the hanger are adjustably connected together by way of the plurality of holes shown at 76 which receive the studs shown at 77. A handle is provided at 78. FIG. 12 illustrates the use of a hanger 71 in conjunction with a division plate 80 which is used to provide a seam in the concrete structure.

Figure 13:
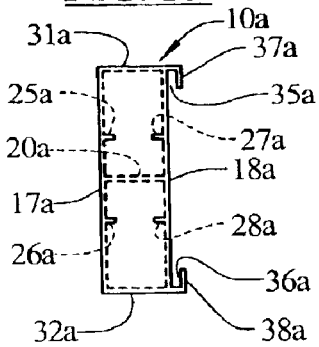
FIG. 13 is an end view of a flexible form made in accordance with the present invention.

FIG. 13 illustrates a cross section of a form 10*a* that has different dimensions than the form 10 illustrated previously. Specifically, the cross section illustrated for the form 10*a* is preferably used for a four inch form, or a form with a front wall 17*a* that is four inches high while the cross section for the form 10 is preferably utilized for a form with a front wall 17 that is six inches high. Aluminum tubes 14 (not shown in FIG. 13) may be inserted into the space defined by the upper wall 31*a* and ledges 25*a*, 27*a* as well as the space defined by the lower wall 32*a* and ledges 26*a*, 28*a*.

Figure 18:
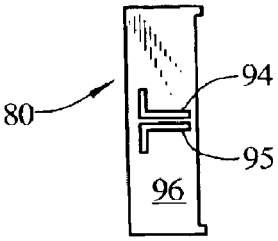
FIG. 18 is a rear view of the end cap shown in FIGS. 14 and 16.
Figure 20:
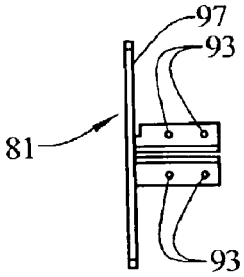
FIG. 20 is a side view of the end cap shown in FIGS. 15, 17 and 19.
Figure 19:
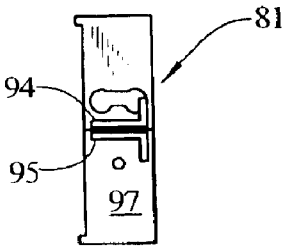
FIG. 19 is a rear view of the end cap shown in FIGS. 15 and 17.

The present invention also provides the improved means for connecting two adjacent forms together in an end-to-end fashion. Specifically, FIGS. 14–17 illustrate the employment of end caps 80, 81 made in accordance with the present invention and disposed in the ends of the forms 10*a* as shown in FIG. 13 or the forms 10 as shown in FIGS. 1–12. The end cap or plug 80 includes an outwardly protruding post 82 and an outwardly protruding cleat 83. The post 82 is received in the hole 84 of the end plug 81. The cleat 83 includes a narrow shaft portion 85 and an enlarged head portion 86. The enlarged head portion 86 can be received in either end 87, 88 of the slot 89 of the end plug 81. Pivotal movement of the two forms with respect to each other results in the narrow shaft portion 85 being received in the narrower portion 91 of the slot 89. If the end caps 80, 81 are to be employed, holes 92 can be provided in the forms 10*a*. The holes 92 are then aligned with the holes 93 in the L-shaped brackets 94, 95 that project inward from the inside surface 96 of the end plug 80 as shown in FIG. 18 or the inside surface 97 of the end plug 81 as shown in FIGS. 19 and 20. The brackets 94, 95 are disposed on either side of the middle horizontal wall 20*a* as shown in FIG. 13.

Figure 23:
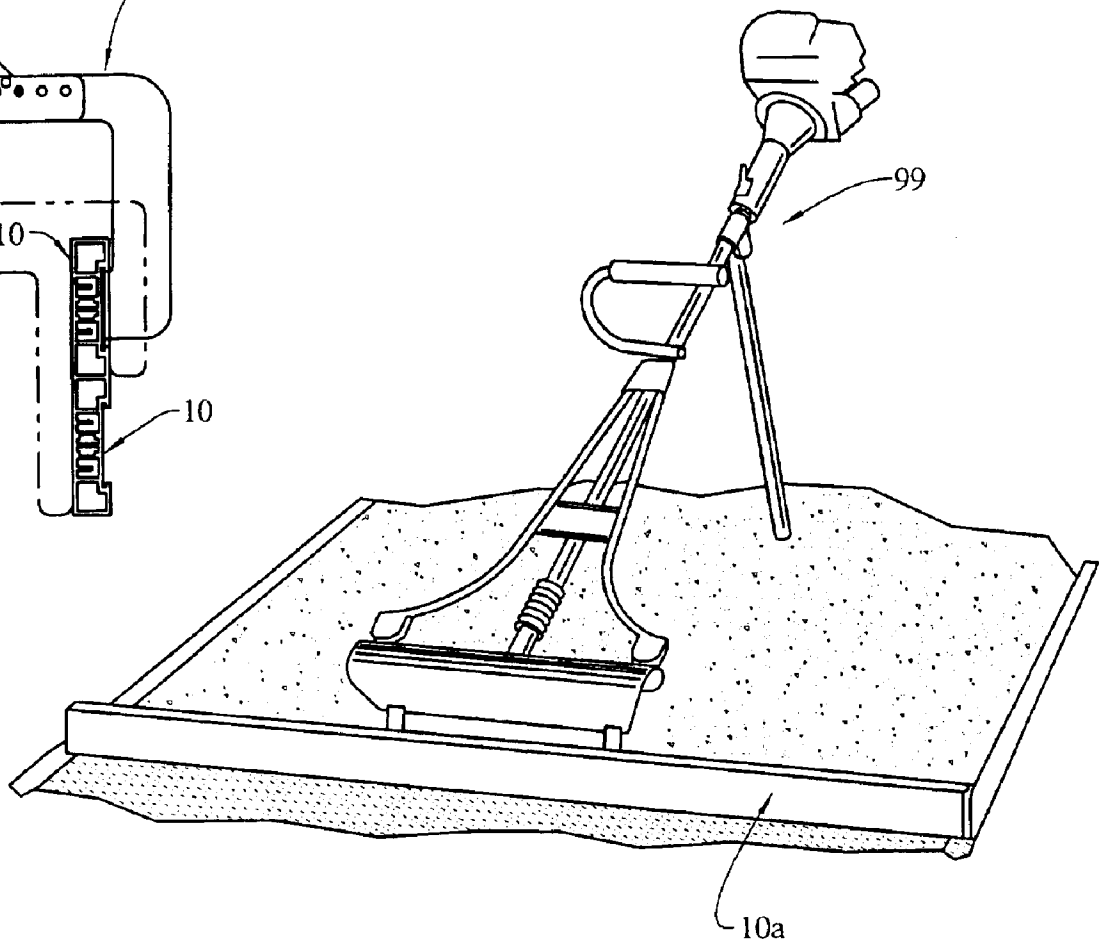
FIG. 23 is a perspective view of a form made in accordance with the present invention as installed on a power screeder.
Figure 21:
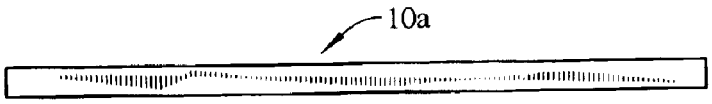
FIG. 21 is a plan view of a flexible form made in accordance with the present invention equipped with two opposing end caps which can be used as a strike-off.
Figure 22:
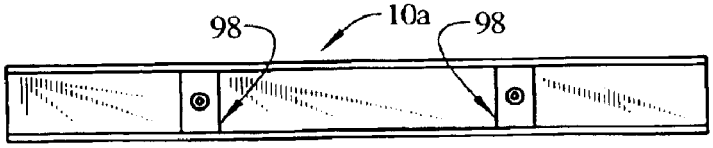
FIG. 22 illustrates a flexible form made in accordance with the present invention as equipped with two end caps and which can be employed for manual or power screeding.
Figure 27:
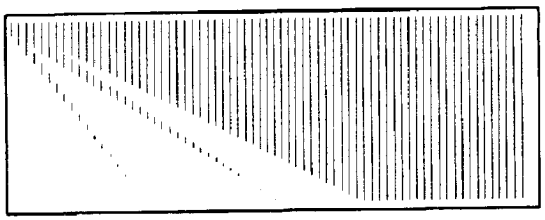
FIG. 27 is a plan view of a living hinge connector made in accordance with the present invention for connecting two adjoining flexible forms made in accordance with the present invention.
Figure 28:
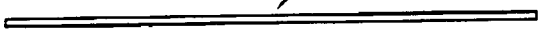
FIG. 28 is a side view of the hinge illustrated in FIG. 27.

FIG. 21 illustrates the use of a form 10*a* as a strike off for cement finishing. FIG. 22 illustrates the use of a form 10*a* equipped with attachment brackets 98 for connecting the form 10*a* to a power screed 99 as illustrated in FIG. 23.

Figure 24:
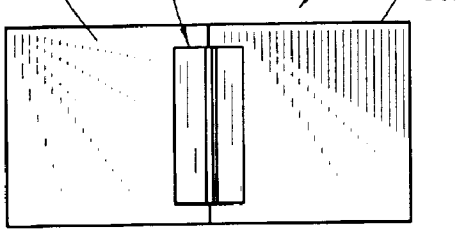
FIG. 24 is a plan view of a hinge made in accordance with the present invention for connecting two adjoining forms made in accordance with the present invention.
Figure 25:
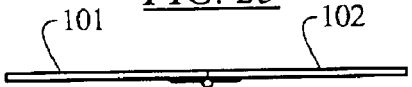
FIG. 25 is a side view of the hinge shown in FIG. 24.
Figure 26:
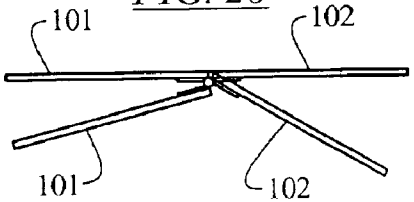
FIG. 26 illustrates the hinge connection provided to two adjoining forms with the hinge connection illustrated in FIGS. 24 and 25.

FIGS. 24–29 illustrate other means for connecting two forms 10 or 10*a* in an end-to-end fashion. FIG. 24 illustrates a hinge mechanism 100 that includes plates 101, 102 connected by a mechanical hinge 103. The plates 101, 102 are received in the C-shaped pocket of two adjacent forms 10 as illustrated schematically in FIG. 25. Accordingly, the forms may be moved from the 180° orientation shown in FIG. 25 to a variety of angular configurations as shown in FIG. 26.

Figure 29:
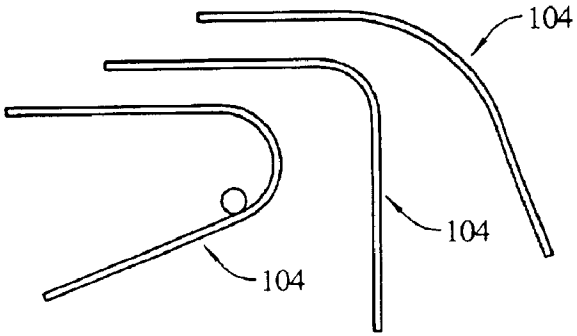
FIG. 29 illustrates the flexibility provided to two adjoining and connected flexible forms that have been connected with the hinge illustrated in FIGS. 27 and 28.

In contrast, a living hinge 104 may be provided to connect two adjacent forms for a curved structure as illustrated schematically in FIG. 29.

Figure 30:
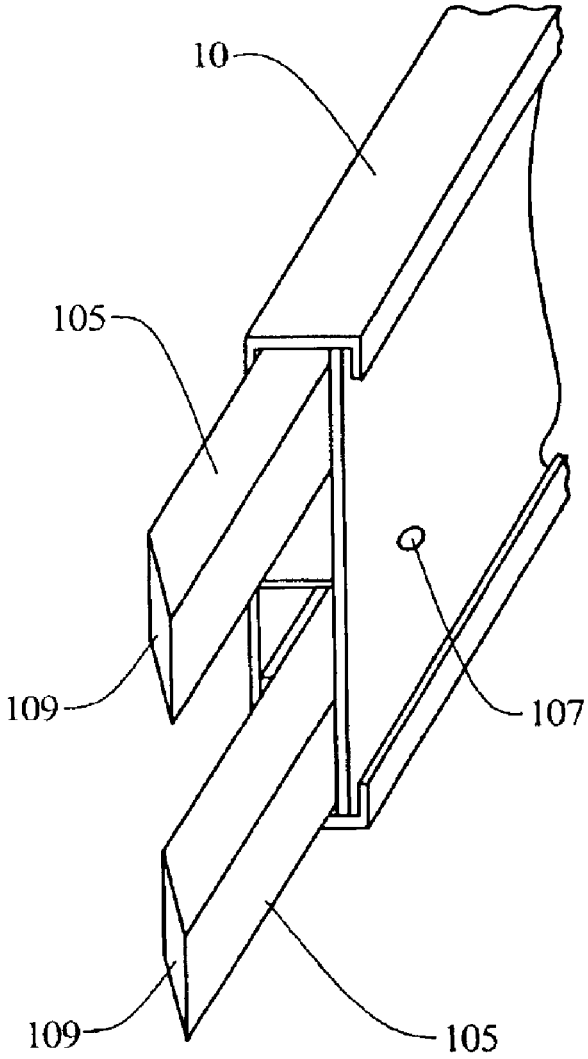
FIG. 30 is a perspective view of an end of a flexible form with two connecting members projecting therefrom.

Another means for connecting two forms in an end-to-end fashion is illustrated in FIG. 30 in which at least one connecting member 105 extends from a pocket defined between the front wall and the back wall of the form. This connecting member can be inserted into a similar pocket in the abutting form.

In an embodiment, at least one mechanical fastener 107 is used to secure the connecting member 105 to one of the walls of the form. In an embodiment, the connecting member 105 is provided with a tapered end 109.

As shown in FIG. 30, two connecting members 105 may be provided, one being spaced above the other. The connecting member 105 preferably projects beyond an end of the form 10 a distance in the range of 3 to 6 inches, and more preferably a distance of approximately 4½ inches.

In an embodiment, the connecting member 105 can comprise a flexible plastic member which is to be used, particularly when the flexible form 10 is used without the reinforcing aluminum tubes 10. This will permit the flexible form to continue around a radius with the connecting members being flexible enough to accommodate the radius. When a flexible plastic member is used as the connecting member 105, this flexible plastic member preferably extends into the form approximately the same distance as it projects beyond the end of the form.

In another embodiment, the rigid aluminum tubes 14 may be staggered within the elongated form 10 so as to project from one end of the form, while they are recessed into the other end of the form. In this manner, the rigid aluminum tube 14 will still extend substantially the entire length of the form 10 to reinforce the length of the form. Thus, the rigid aluminum tube 14 also acts as the connecting member 105 with the projecting portion being inserted into the adjacent form.

By use of the connecting member 105 that projects into a pocket of two abutting forms 10, accommodation is provided for expansion and contraction of the forms due to temperature changes, particularly when the connecting member extends 3 to 6 inches into the adjacent form, which would more than accommodate normal expansion and contraction of the forms. The inserted connecting members allow the forms 10 to stay aligned, particularly in flexible applications where the forms are bent about a tight radius.

With the ends 109 of the connecting members 105 being tapered, and particularly where multiple connecting members are used and a common taper is provided, such as both connecting members having a taper formed on one side, as shown in FIG. 30, the insertion of the connecting members into an adjacent form 10 is carried out with ease.

Although various types of mechanical fasteners 107 could be utilized to secure the connecting members to the forms, including staples, screws, interlocking tabs, holes and projections, etc., a simple mechanical grade rivet could be used in an economical fashion.

As shown in FIGS. 1 and 30, the present invention provides a form assembly 10 for forming a concrete structure during drying of the concrete, the form assembly including an elongated plastic form 10 having the front wall 17 for engaging the concrete and a rear wall 18. The front wall 17 is spaced apart from the back wall 18. The front 17 and back 18 walls define the pocket therebetween for receiving at least one connecting member 13, 14, 105 having a front and back surface. Each of the walls 17, 18 has a height at least as great as a height of tho connecting member 13, 14, 105 and a length extending at least half of a length of the connecting member such that a full height and length of the front surface of the connecting member is covered by the front wall 17 and a full height and length of the back surface of the connecting member is covered by the back wall 18.

As is apparent from the foregoing specification, the invention is susceptible of being embodied with various alterations and modifications which may differ particularly from those that have been described in the preceding specification and description. It should be understood that we wish to embody within the scope of the patent warranted hereon all such modifications as reasonably and properly come within the scope of our contribution to the art.

The embodiments of the invention in which an exclusive property or privilege is claimed are defined as follows:

1. A form assembly for forming a concrete structure during drying of the concrete, the form assembly comprising:

an elongated plastic form comprising a front wall for engaging the concrete and a rear wall;

said front wall being spaced apart from said back wall;

said front and back walls defining a pocket therebetween for receiving at least one connecting member having a front and back surface, and each of said walls having a height at least as great as a height of said connecting member and length extending at least half of a length of said connecting member such that a full height and a full length of said front surface of said connecting member is covered by said front wall and a full height and a full length of said back surface of said connecting member is covered by said back wall when the elongated plastic form is connected adjacent elongated plastic form;

said connecting member being secured in said pocket to project a distance beyond an end of said form.

2. The form assembly of claim 1, wherein said at least one connecting member is secured to one of said walls of said form by at least one mechanical fastener to prevent movement of said connecting member relative to said one of said walls.

3. The form assembly of claim 1, wherein said at least one connecting member has a tapered end.

4. The form assembly of claim 1, wherein said at least one connecting member comprises two connecting members, one spaced above the other.

5. The form assembly of claim 1, wherein said at least one connecting member comprises a flexible plastic member.

6. The form assembly of claim 5, wherein said flexible plastic member extends into said form approximately the same distance as it projects beyond said end.

7. The form assembly of claim 1, wherein said at least one connecting member comprises a rigid aluminum tube.

8. The form assembly of claim 7, wherein said rigid aluminum tube extends substantially an entire length of said form to reinforce said length of said form.

9. The form assembly of claim 1, wherein said at least one connecting member projects beyond said end of said form a distance in the range of 3 to 6 inches.

10. The form assembly of claim 9, wherein said at least one connecting member projects beyond said end of said form a distance of approximately 4.5 inches.

11. A form assembly for forming a concrete structure during drying of the concrete, said form assembly comprising:

an elongated form comprising a front side for engaging the concrete and a rear side, said rear side comprising a back wall disposed between rearwardly extending top and bottom walls, said top wall being connected to a downwardly protruding upper lip, said bottom wall being connected to an upwardly protruding lower lip;

said upper and lower lips, said top and bottom walls and said back wall forming a C-shaped pocket for receiving a slidable stake holder;

said stake holder comprising right and left flanges that abuttingly engage said back wall, that fit between said top and bottom walls and that are partially disposed between said upper and lower lips and said back wall such that said stake holder can slide along said back wall;

said stake holder further comprising a pocket portion that is connected to and disposed between said right and left flanges, said pocket portion extending outward rearwardly to define an apex which provides a looped pocket for receiving a stake; and said stake holder further comprising at least one preformed nail hole in each of said right and left flanges;

said elongated form further comprising a front wall at said front side fur engaging the concrete;

said front wall being spaced apart from said back wall by a top wall and a bottom wall;

said front, top, bottom and back walls defining and enclosing a pocket for receiving at least one connecting member, said pocket having a length extending at least half of a length of said connecting member;

said connecting member being secured in said pocket to project a distance beyond an end of said form.

12. The form assembly according to claim 11 wherein said elongated form is formed of a flexible plastic material.

13. The form assembly of claim 11, wherein said at least one connecting member is secured to one of said walls of said form by at least one mechanical fastener to prevent movement of said connecting member relative to said one of said walls.

14. The form assembly of claim 11, wherein said at least one connecting member has a tapered end.

15. The form assembly of claim 11 wherein said at least one connecting member comprises two connecting members, one spaced above the other.

16. The form assembly of claim 11 wherein said at least one connecting member projects beyond said end of said form a distance in the range of 3 to 6 inches.

17. The form assembly of claim 16 wherein said at least one connecting member projects beyond said end of said form a distance of approximately 4.5 inches.

18. A form assembly for forming a concrete structure during drying of the concrete, the form assembly comprising:

an elongated plastic form comprising a front wall for engaging the concrete and a rear wall;

at least two connecting members having a front surface and a back surface;

said front wall being spaced apart from said back wall;

said front and back walls defining a pocket for receiving said connecting members spaced one above the other, and each of said walls having a height at least as great as a height of said connecting member and a length extending at least half of a length of said connecting member such that a full height and a full length of said front surface of said connecting member is covered by said front wall and a full height and a full length of said back surface of said connecting member is covered by said back wall when the elongated plastic form is connected to adjacent elongated plastic form;

said connecting members being secured in said pocket to project a distance beyond an end of said form;

said connecting members being secured to one of said walls of said form by at least one mechanical fastener to prevent movement of said connecting member relative to said one of said walls;

said connecting members each having a commonly tapered projecting end;

said connecting members projecting beyond said end of said form a distance in the range of 3 to 6 inches.

* * * * *